US009831572B2

(12) United States Patent
McColloch

(10) Patent No.: US 9,831,572 B2
(45) Date of Patent: Nov. 28, 2017

(54) SOCKETLESS LAND GRID ARRAY

(71) Applicant: Avago Technologies General IP (Singapore) Pte. Ltd., Singapore (SG)

(72) Inventor: Laurence R. McColloch, Santa Clara, CA (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 88 days.

(21) Appl. No.: 14/573,857

(22) Filed: Dec. 17, 2014

(65) Prior Publication Data

US 2016/0181709 A1 Jun. 23, 2016

(51) Int. Cl.
*H01R 12/52* (2011.01)

(52) U.S. Cl.
CPC ..... *H01R 12/523* (2013.01)

(58) Field of Classification Search
CPC ..... H01R 12/523
See application file for complete search history.

(56) References Cited

U.S. PATENT DOCUMENTS

2007/0257091 A1* 11/2007 Kuczynski ..... B23K 35/268 228/246
2010/0167466 A1* 7/2010 Adimula ..... H01L 23/3121 438/108
2010/0284698 A1* 11/2010 McColloch ..... G02B 6/4201 398/135
2013/0105975 A1* 5/2013 Hussain ..... H01L 21/563 257/741
2014/0231989 A1 8/2014 Pagaila et al.

FOREIGN PATENT DOCUMENTS

WO WO2014146134 A1 9/2014

OTHER PUBLICATIONS

"Engineered Material Systems to Debut Low-Cost Conductive Adhesive for Back Contact Solar Modules at SNEC 2013," SMT, PCB Electronics Industry News, http://www.smtnet.com/news/index, Apr. 25, 2013, 1 page, Engineered Material Systems.

* cited by examiner

*Primary Examiner* — Melissa Koval
*Assistant Examiner* — Haidong Zhang

(57) ABSTRACT

A socketless land grid array (LGA) is provided that uses an adhesive material rather than a socket to secure the optical communications module to the LGA and to provide the clamping force that is needed to maintain contact between the module and the LGA and to maintain a flat profile for the module and the LGA. Eliminating the LGA socket eliminates the need to drill holes in the host circuit board and the need for additional hardware (e.g., backing plates, screws, etc.) to secure a socket to the host circuit board. This allows the area of the host circuit board underneath the array of electrical contacts of the LGA to be used for routing electrically-conductive pathways of the host circuit board (e.g., vias and traces) and reduces the amount of time and effort that are needed to secure modules to the respective LGAs.

19 Claims, 6 Drawing Sheets

SOCKETLESS LAND GRID ARRAY

TECHNICAL FIELD OF THE INVENTION

The invention relates to optical communications modules. More particularly, the invention relates to a socketless land grid array (LGA).

BACKGROUND OF THE INVENTION

A parallel optical communications module is an optical communications module that has multiple transmit (TX) channels, multiple receive (RX) channels, or both. A parallel optical transceiver module is an optical communications module that has multiple TX channels and multiple RX channels in the TX and RX portions, respectively, of the module. A parallel optical transmitter module is an optical communications module that has multiple TX channels, but no RX channels. A parallel optical receiver module is an optical communications module that has multiple RX channels, but no TX channels.

The TX portion of a parallel optical transceiver or transmitter module comprises components for generating modulated optical signals, which are then optically coupled by an optics system of the module into the ends of respective optical fibers and transmitted over an optical link or network. The TX portion typically includes laser diode or light emitting diode (LED) driver circuitry and a plurality of laser diodes or LEDs. The driver circuitry outputs electrical signals to the laser diodes or LEDs to modulate them. When the laser diodes or LEDs are modulated, they output optical signals that have power levels corresponding to logic 1s and logic 0s. The optics system of the module directs the optical signals produced by the laser diodes LEDs into the ends of respective optical fibers, which are typically held within an optical connector that mates with the parallel optical transceiver or transmitter module.

The RX portion of a parallel optical transceiver or receiver module includes a plurality of receive photodiodes that receive incoming optical signals output from the ends of respective optical fibers, which are typically held in an optical connector that mates with the parallel optical transceiver or receiver module. The optics system directs the light that is output from the ends of the optical fibers onto the respective photodiodes. The photodiodes convert the incoming optical signals into electrical analog signals. An electrical detection circuit, such as a transimpedance amplifier (TIA), receives the electrical signals produced by the photodiodes and outputs corresponding amplified electrical signals, which are processed by other receiver circuitry in the RX portion to recover the data.

A mid-plane mounting configuration for a parallel optical communications module is one in which the module is mounted on the surface of a host printed circuit board (PCB). A typical mid-plane mounting configuration includes an LGA socket that is mounted on the host PCB and a parallel optical communications module that is mounted in the socket. The LGA socket has a bottom and typically has side walls. Arrays of electrical contacts are disposed on upper and lower surfaces of the bottom of the socket. The parallel optical communications module has a module PCB having an array of electrical contacts disposed on its lower surface. The electrical contacts on the lower surface of the module PCB electrically connect with respective electrical contacts of the array disposed on the upper surface of the socket when the module is mounted on the socket.

The LGA socket is typically secured to the upper surface of the host PCB by drilling holes through the host PCB and inserting fastening devices (e.g., screws) through the holes formed in the host PCB and through holes formed in the socket to fasten the socket to the host PCB. After the socket has been secured to the host PCB, the optical communications module is mounted on the socket such that the array of electrical contacts disposed on the lower surface of the module is electrically connected to the array of electrical contacts disposed on the upper surface of the bottom of the socket. The LGA socket locates, compresses and holds the optical communications module in a fixed position on the host PCB and electrically interfaces the electrical contacts disposed on the lower surface of the module PCB with respective electrical contacts disposed on the upper surface of the host PCB.

A backing plate is often secured to the backside of the host PCB and is mechanically coupled to the LGA socket to provide support for the host PCB at the mounting location. A similar plate is often secured to the front side of the host PCB and used as a cover to maintain a flat profile for the mounted configuration of the module within the LGA socket. These plates are typically secured to the host PCB by screws or similar fastening devices.

Securing the socket to the host PCB in this manner reduces mechanical shocks and vibrations to the module that could otherwise damage the module or detrimentally affect its performance due to loss of connectivity between socket and module. One of the problems associated with securing the socket to the host PCB in this manner is that electrical conductors of the host PCB (i.e., vias and traces) cannot be routed through the locations where the holes have been drilled in the host PCB. This presents challenges when it comes to designing the routes of the host PCB. Another problem is that the LGA sockets often are relatively expensive, large in size, and have to be hand-assembled (e.g., drilling holes, soldering, attaching plates, etc.), which leads to a mid-plane mounting solution that is relatively expensive and time consuming to implement.

A need exists for an LGA for mid-plane mounting a parallel optical communications module on a host PCB that eliminates the need for the socket, thereby reducing cost, size and the need to perform a large number of assembly operations by hand.

SUMMARY OF THE INVENTION

In accordance with an embodiment, a socketless LGA is provided that comprises a first mounting region of a first surface of a first host circuit board (CB), a first array of electrical contacts disposed on the first surface of the first host CB in the first mounting region, and a first amount of non-electrically-conductive adhesive material disposed on the first surface of the first host CB in the first mounting region.

In accordance with another embodiment, an electrical interface is provided for interfacing module CBs with host CBs. The electrical interface comprises: a plurality of mounting regions of a first surface of a first host CB; a plurality of first arrays of electrical contacts disposed on the first surface of the first host CB in the respective mounting regions; first amounts of non-electrically-conductive adhesive materials disposed on the first surface of the first host CB in the respective mounting regions; a plurality of first modules mounted in the respective mounting regions, each of which has a first module CB having second array of electrical contacts disposed on a first surface thereof, where the electrical contacts of the first array are in contact with respective electrical contacts of the second array; and first amounts of non-electrically-conductive adhesive material disposed on the electrical contacts of the first and second arrays and securing the electrical contacts of the first array to the respective electrical contacts of the second array. The first amounts of adhesive material are in contact with the first surface of the first host CB and with the first surface of the first module CBs and secure the first module CBs to the first host CB in the respective mounting regions.

In accordance with another embodiment, a socketless LGA is provided consisting of the following: a first mounting region of a first surface of a first host CB; a first array of electrical contacts disposed on the first surface of the first host CB in the first mounting region; and a first amount of non-electrically-conductive adhesive material in contact with the first surface of the first host CB and with the first surface of the first module CB, where the first amount of non-electrically-conductive adhesive material is the only mechanism used to maintain physical contact between the first module CB and the first host CB and to prevent movement between the first module CB and the first host CB.

These and other features and advantages of the invention will become apparent from the following description, drawings and claims.

DETAILED DESCRIPTION OF AN ILLUSTRATIVE EMBODIMENT

Figure 1:
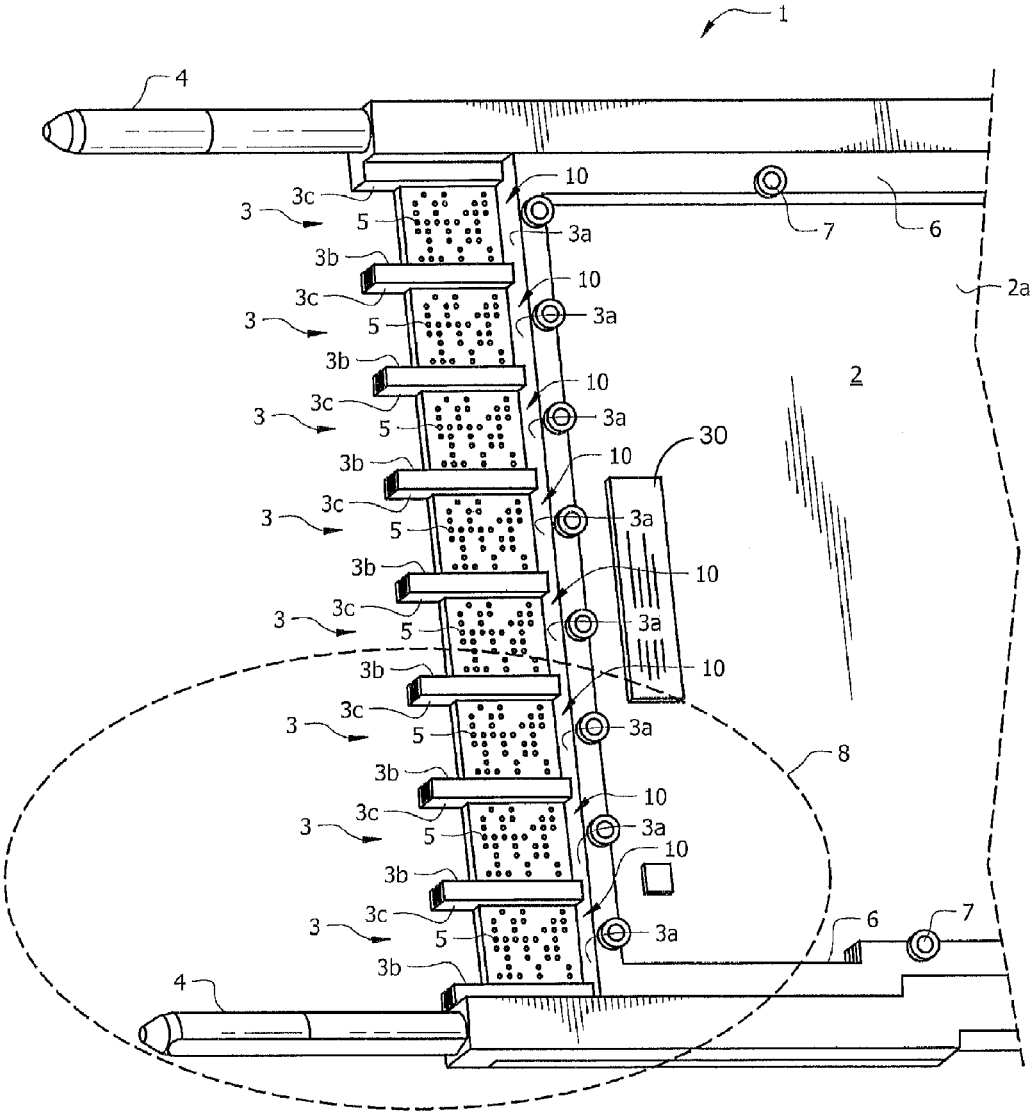
FIG. 1 illustrates a top perspective view of a PCI card having a host circuit board that has a plurality of mounting areas for mounting respective parallel optical communications modules thereon.

In accordance with the invention, a socketless LGA is provided that uses an adhesive material rather than a socket to secure an optical communications module to the LGA. The adhesive bond provides the clamping force that is needed to maintain contact between the module and the LGA and that is needed to maintain a flat profile for the mounted configuration of the module on the LGA. Eliminating the LGA socket eliminates the need to drill holes in the host circuit board and the need for additional hardware (e.g., backing plates, screws, etc.) to secure a socket to the host circuit board. This allows the area of the host circuit board underneath the array of electrical contacts of the LGA to be used for routing electrically-conductive pathways of the host circuit board (e.g., vias and traces), reduces the amount of time and effort that are needed to secure modules to the respective LGAs, and reduces the final solution size both within the plane of the host circuit board and in total thickness.

An illustrative, or exemplary, embodiment of the socketless LGA and the manner in which it may be used with a parallel optical communications module will now be described with reference to the FIGS. 1-6, in which like reference numerals represent like elements, components or features. It should be noted that features in the figures are not necessarily drawn to scale, emphasis instead being placed on demonstrating principles and concepts of the invention.

The term "circuit board," or CB, as those terms are used herein, are intended to denote any circuit board, including, but not limited to, a PCB, a flex circuit, or any other substrate having electrical conductors routed through it on which the socketless LGA may be formed. The term "parallel optical communications module," as that term is used herein, is intended to denote any one of a parallel optical transceiver module, a parallel optical receiver module, or a parallel optical transmitter module.

For illustrative, or exemplary purposes, the socketless LGA will be described as being used with a Peripheral Component Interconnect (PCI) card having a plurality of parallel optical communications modules mounted on it that are interconnected with other system modules when the PCI card is plugged into a PCI slot. The PCI card is merely an example of one possible implementation scenario for the socketless LGA and is intended to demonstrate one of a virtually infinite number of possible applications for the socketless LGA.

FIG. 1 illustrates a top perspective view of a PCI card 1 having a host CB 2 that has a plurality of mounting areas 3 for mounting respective parallel optical communications modules (not shown) thereon. The PCI card 1 has cylindrical pins 4 on opposite sides of a forward end thereof for mating with respective bores (not shown) of a PCI slot (not shown). In accordance with this illustrative embodiment, each mounting area 3 is surrounded on three sides by frame members 3*a*-3*c* of the PCI card 1. Each mounting area 3 of the host CB 1 has an array of electrical contacts 5 thereon that, together with the portions of the CB 2 within the mounting areas 3 and the adhesive material (not shown), comprise the socketless LGA 10, as will be described below in more detail. The adhesive material is a non-electrically-conductive adhesive material so that it does not create a short circuit between neighboring electrical contacts 5. The frame member 3*a* of each of the mounting areas 3 is part of a larger frame 6 of the PCI card 1 that, along with fastening members 7, holds the host CB 2 in position on the PCI card 1. The frame 6 is typically made of a hard plastic material, although other materials may be used for this purpose.

Figure 2:
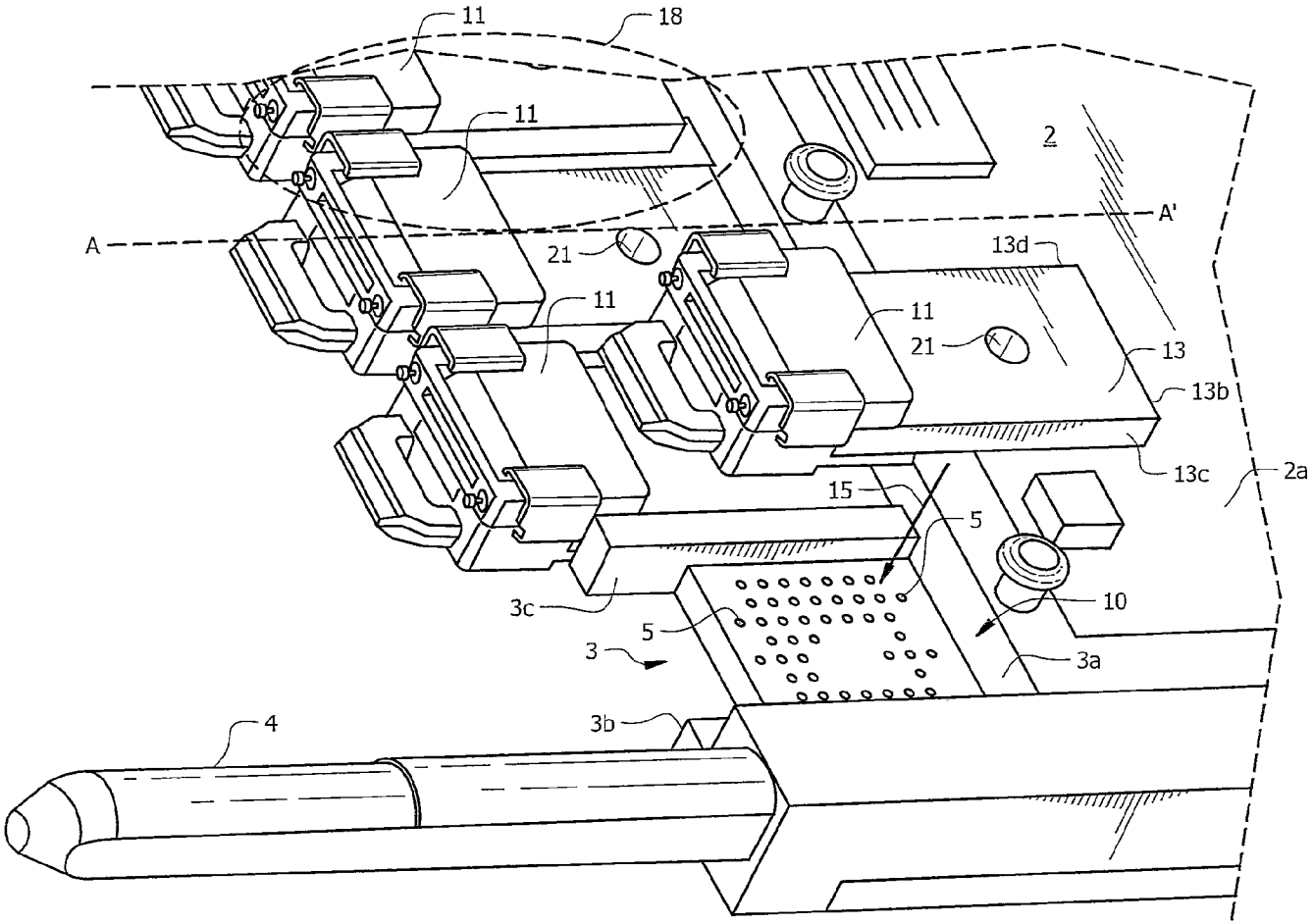
FIG. 2 illustrates an enlarged top perspective view of the portion of the PCI card shown in the dashed circle labeled with reference numeral 8 in FIG. 1, except that the portion of the PCI card shown in FIG. 2 has a plurality of parallel optical communications modules mounted thereon in the respective mounting areas.
Figure 3A:
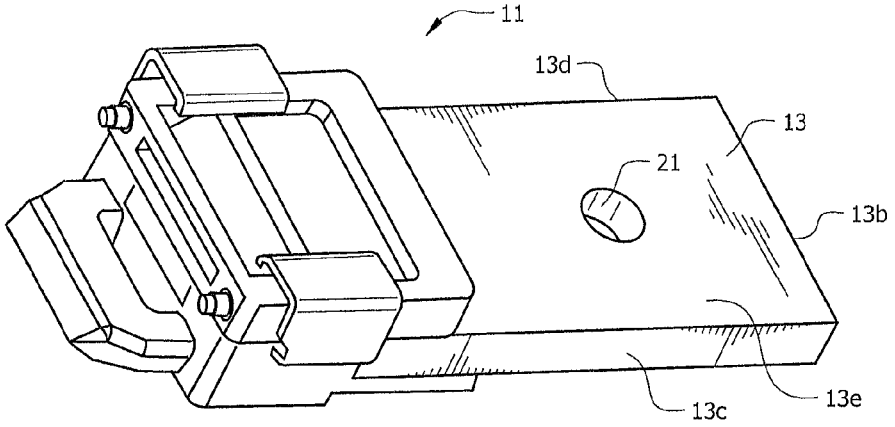
FIGS. 3A and 3B illustrate top and bottom perspective views, respectively, of one of the parallel optical communications modules shown in FIG. 2.
Figure 3B:
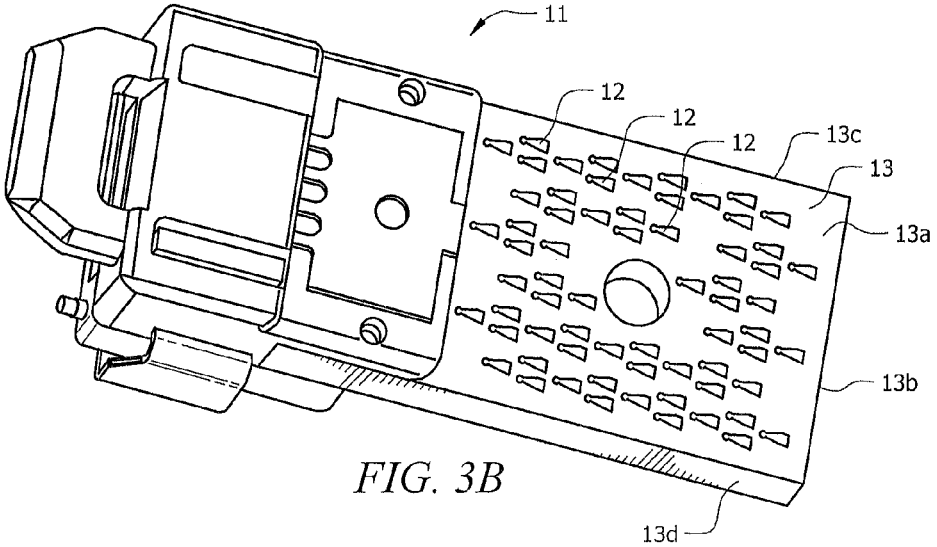

FIG. 2 illustrates an enlarged top perspective view of the portion of the PCI card 1 shown in the dashed circle labeled with reference numeral 8 in FIG. 1, except that the portion of the PCI card 1 shown in FIG. 2 has a plurality of parallel optical communications modules 11 mounted thereon in the respective mounting areas 3. In FIG. 2, one of the parallel optical communications modules 11 is positioned above its respective mounting area 3 as it is about to be mounted on the respective LGA 10. FIGS. 3A and 3B illustrate top and bottom perspective views, respectively, of one of the parallel optical communications modules 11 shown in FIG. 2. As shown in FIG. 3B, the module 11 has an array of electrical contacts 12 disposed on a lower surface 13*a* of a module CB 13. When the modules 11 are mounted on the respective socketless LGAs 10 as shown in FIG. 2, the electrical contacts 5 of the socketless LGAs 10 are in contact with respective electrical contacts 12 (FIG. 3B) of the array disposed on the lower surface 13*a* of the module CB 13.

In accordance with illustrative embodiments described herein, the frame members 3*a*-3*c* (FIGS. 1 and 2) of the host CB 2 that surround the mounting areas 3 abut the sides 13*b*-13*d*, respectively, of the module CB 13 when the modules 11 are mounted in the mounting areas 3. This abutment between the frame members 3*a*-3*c* and the sides 13*b*-13*d*, respectively, of the module CB 13 aligns the module 11 with the LGA 10 and brings the electrical contacts 5 of the array of the LGA 10 into contact with the respective electrical contacts 12 of the array of the module CB 13. When the modules 11 are mounted on the respective LGAs 10, the abutment of the electrical contacts 5 and 12 creates a small space in between the lower surface 13*a* of the module CB 13 and the upper surface 2*a* of the host CB 2.

Because the LGAs 10 (FIGS. 1 and 2) are socketless, some mechanism other than plates and the like that are used with conventional LGA sockets must be used to provide the force needed to maintain contact between the electrical contacts 5 and 12 and to maintain a flat profile for the mounted configuration of the modules 11 on the respective LGAs 10. The manner in which this is accomplished in accordance with an illustrative embodiment will now be described with respect to FIGS. 1-4B.

Figure 4A:
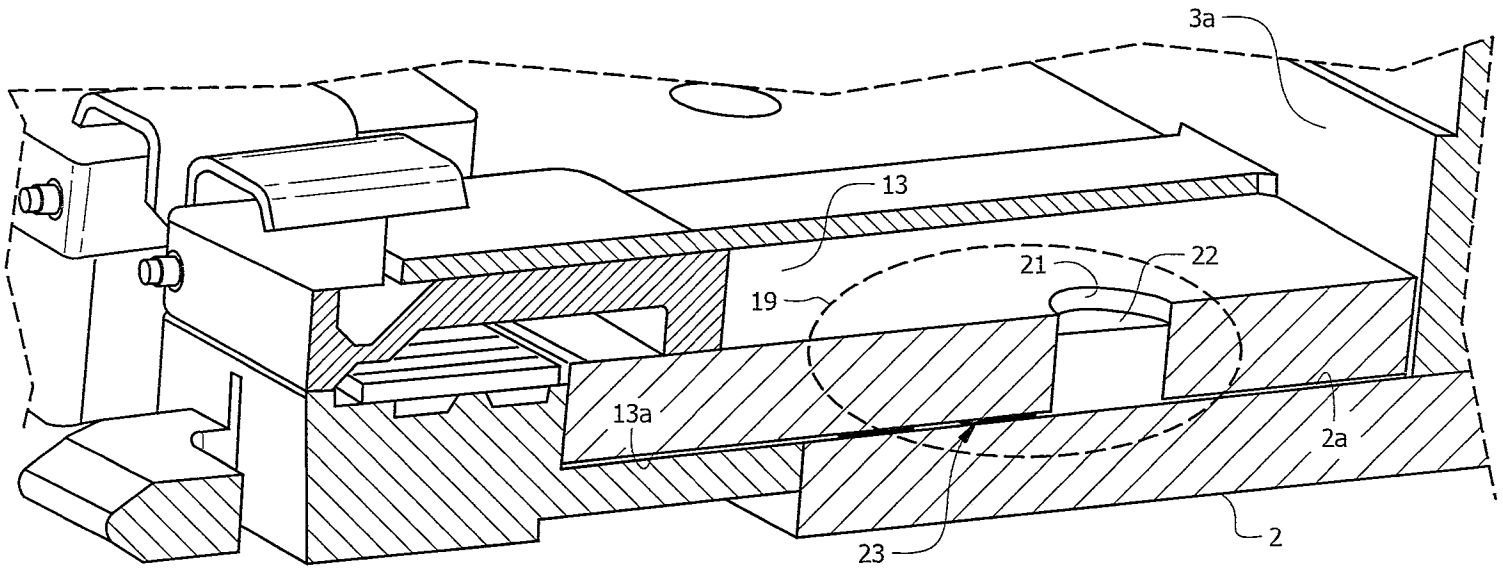
FIG. 4A illustrates a cross-sectional perspective view of the portion of the mounted configuration of the module and its respective LGA contained in the dashed circle labeled with reference numeral 18 in FIG. 2 and taken along dashed line A-A' in FIG. 2.
Figure 4B:
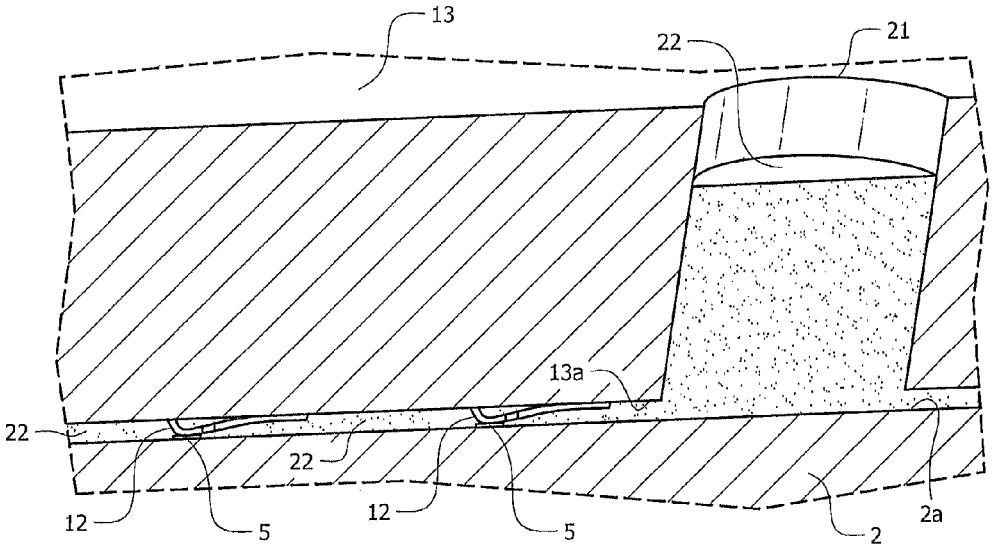
FIG. 4B illustrates an enlarged view of the portion of the mounted configuration of the module and its respective LGA contained in dashed circle labeled with reference numeral 19 in FIG. 4A.

FIG. 4A illustrates a cross-sectional perspective view of the portion of the mounted configuration of the module 11 and its respective LGA 10 contained in the dashed circle 18 in FIG. 2 and taken along dashed line A-A' in FIG. 2. FIG. 4B illustrates an enlarged view of the portion of the mounted configuration of the module 11 and its respective LGA 10 contained in dashed circle 19 in FIG. 4A. Once the module 11 has been mounted in the corresponding mounting area 3 on the corresponding LGA 10, a tool (not shown) holds the module 11 in position as an adhesive material 22 (e.g., epoxy or glue) is injected into the space in between the lower surface 13*a* of the module CB 13 and the upper surface 2*a* of the host CB 2 in the mounting areas 3. Prior to the adhesive material being injected, the parallel optical communications modules 11 can be tested to ensure that they perform satisfactorily prior to them being permanently secured to the LGA 10. This allows faulty modules 11 to be replaced before they are permanently secured to the LGA 10.

In accordance with this illustrative embodiment, the module CB 13 has a through hole 21 (FIGS. 2-4B) formed in it through which the adhesive material 22 is injected. This feature allows the modules 11 to be mounted on the respective LGAs 10 prior to the adhesive material 22 being dispensed into the space between the lower surface 13*a* of the module CB 13 and the upper surface 2*a* of the host CB 2. The tool applies a sufficient amount of downward force in the direction indicated by arrow 15 in FIG. 2 to press the module 11 against the LGA 10 until the adhesive material sets, or cures. This ensures that the mounted configuration of the module 11 on the LGA 10 has a relatively flat profile (i.e., a short height on the host CB 2) and that the respective electrical contacts 5 and 12 of the arrays of the LGA 10 and of the module CB 13 are permanently secured to one another and are in good electrical contact with one another. The same tool or a different tool (not shown) may also be used to provide a force against the opposite side of the host CB 2 in a direction opposite the direction represented by arrow 15 (FIG. 2) to perform a support function similar to that provided by traditional backing plates. After the module 11 has been secured to the LGA 10, the tool can be removed, leaving only the mounted configuration of the module 11 on the LGA 10.

It should be noted that although the illustrative embodiment uses the frame members 3*a*-3*c* of the host CB 2 to passively locate the modules 11 on the respective LGAs 10 to thereby passively align the respective electrical contacts 5 and 12 of the respective arrays, other devices and techniques may be used for this purpose. For example, mating features on the module and on the host CB (e.g., pins disposed on the upper surface 2*a* of the host CB 2 and complementarily-shaped and sized holes formed in the module CB 13) that mate with one another may be used for this purpose. Active alignment devices and techniques may also be used for this purpose. For example, it is known to use fiducial markings on a host CB and a machine vision system to locate and align elements on a CB. Particular features of the host CB 2 and of the module 11 can also be used to perform active alignment, such as the shape of the module 11 and the shape of one or more elements disposed on the host CB 2 and their spatial relationship to one another when viewed by the vision system. For example, the pattern of electrical contacts 5 of each LGA 10 may be used by a machine vision system as a fiducial on the host CB 2 to align the sides 13*b*-13*d* of the module CBs 13 with the respective LGAs 10. Known machine vision systems and pattern recognition techniques may be used for this purpose. In such cases, the need for the frame members 3*a*-3*c* or other passive alignment devices or features is eliminated.

Figure 6:
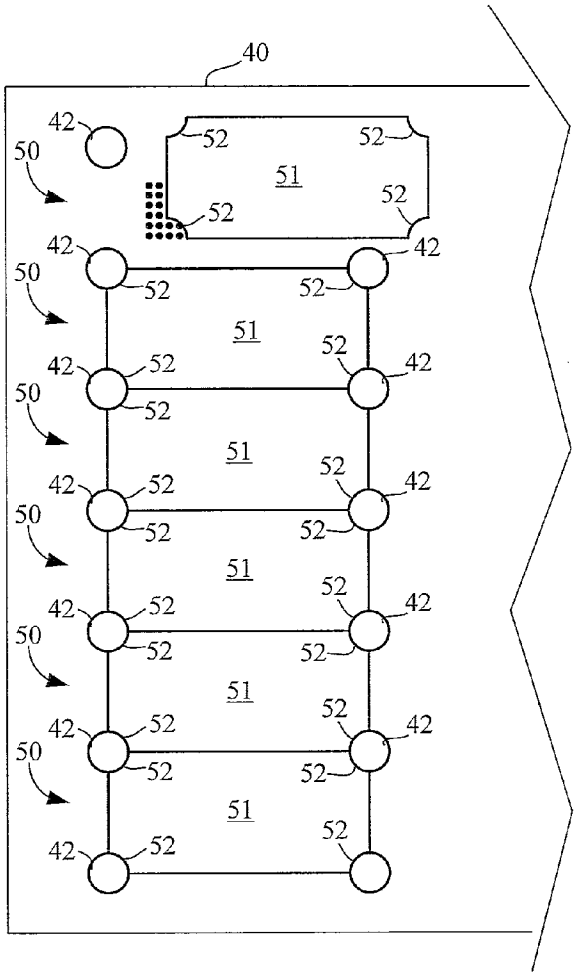
FIG. 6 illustrates a top view of the socketless LGAs shown in FIG. 5 with respective module circuit boards mounted on them.
Figure 5:
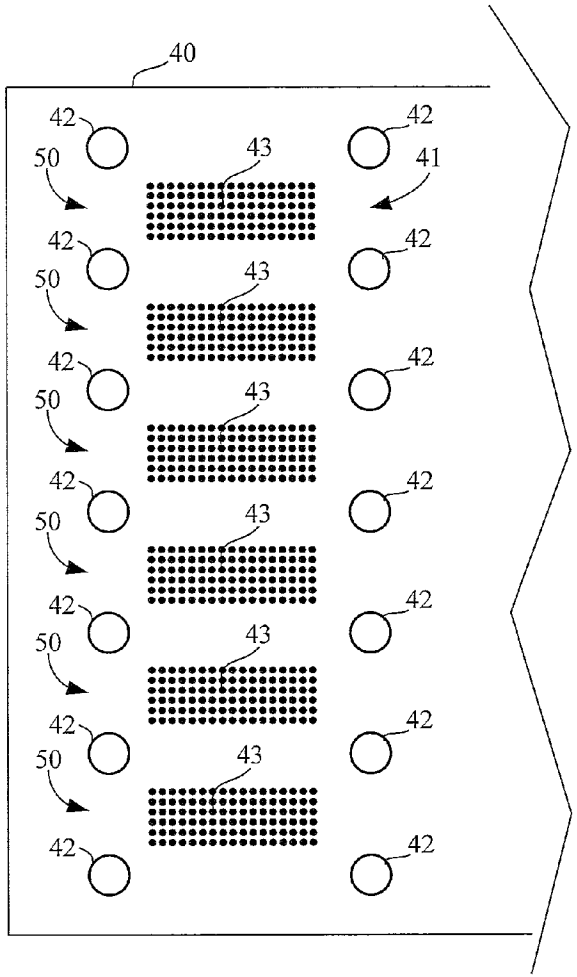
FIG. 5 illustrates a top view of a portion of a host circuit board of a parallel optical communications module having a plurality of socketless LGAs formed thereon in accordance with another illustrative embodiment.

FIG. 5 illustrates a top view of a portion of a host CB 40 of a parallel optical communications module having a plurality of mounting areas 41, each of which is defined by four round pins 42 that are used for passive alignment and an array of electrical contacts 43. The portion of the host CB 40 within each of the mounting areas 41 and the corresponding array of electrical contacts 43 comprise a respective socketless LGA 50. FIG. 6 illustrates a top view of the socketless LGAs 50 shown in FIG. 5 with respective module CBs 51 mounted on them. In FIG. 6, one of the module CBs 51 is laterally offset from its respective socketless LGA 50 to show mating features 52 of the module CBs 51 that mate with the respective pins 42 of the respective socketless LGAs 50. The mating features 52 are semicircular corners of the CBs 51 that are complementary in shape and diameter to the circular or cylindrical side walls of the pins 42.

In accordance with this illustrative embodiment, the pins 42 and the corners 52 operate as passive alignment features for passively locating or positioning the module CBs 51 on the respective mounting areas 41, which aligns the electrical contacts of an array (not shown) disposed on a lower surface of the module CB 51 with the respective electrical contacts 43 of the respective array of the LGA 50. An adhesive material such as epoxy or glue is dispensed onto one or both of the arrays of electrical contacts either before or after the modules have been mounted on the host CB 40 in one of the manners described above to secure the modules to the host CB 40.

As is typically the case with host CBs, the host CBs 2 and 40 have electrical conductors (not shown) such as vias and traces running through them. These electrical conductors electrically interconnect the socketless LGAs of the host CBs with the other electrical circuitry mounted on the module CBs. For exemplary purposes, an integrated circuit chip 30 is shown mounted on the upper surface 2*a* of the host CB 2. In an illustrative embodiment, the chip 30 is a controller chip and the modules 11 are in communication with the controller chip 30 via the arrays of electrical contacts 5 and 12 and the electrical conductors routed in or on the host CB 2.

It should also be noted that although the step of injecting the adhesive material into the space in between the upper and lower surfaces 2*a* and 13*a* of the host CB 2 and the module CB 13, respectively, has been described as occurring after the module 11 has been mounted on the LGA 10, the injection step may occur before the module 11 has been mounted on the LGA 10. In cases where the injection step is performed before the module 11 has been mounted on the LGA 10, the electrical contacts 5 and 12 should have structures that cause the adhesive material to be removed by the force of the physical contact between the respective electrical contacts 5 and 12 during the mounting process. In the latter case, greater force will be applied by the electrical contacts 5 and 12 to one another during the mounting process to cause the adhesive material to be removed to ensure good electrical contact between the respective electrical contacts 5 and 12. For that reason, in those embodiments, the electrical contacts 5 and 12 need to be strong enough to withstand such a force. In cases where the injection step is to be performed after the module 11 has been mounted on the LGA 10, the through hole 21 is merely on example of a solution for allowing the adhesive material to be injected into the space between the upper surface 2*a* of the host CB 2 and the lower surface 13*a* of the module CB 13. For example, the through hole could instead be formed through the host CB 2. As another example, the frame members 3*a*-3*c* could be modified to include a passage for introducing the adhesive material into the space between the upper surface 2*a* of the host CB 2 and the lower surface 13*a* of the module CB 13.

It should be apparent from the above description of the illustrative embodiments that by obviating the need for an LGA socket the invention obviates the need to drill holes in the host CB 2 as well as the need for additional hardware (e.g., backing plates, screws, etc.). These features allow the area of the host CB 2 underneath the array of electrical contacts 5 to be used for routing of electrically-conductive pathways, such as vias and traces, reduce the overall cost of the LGA 10 and reduce the amount of time and effort that are needed to secure the modules 11 to the respective LGAs 10.

It should be noted that the invention has been described with reference to illustrative embodiments for the purposes of demonstrating the principles and concepts of the invention. The invention, however, is not limited to these examples, as will be understood by persons of skill in the art in view of the description being provided herein. Many modifications may be made to the embodiments described while still achieving the goal of the invention.

For example, although the illustrative embodiments have been described with reference to securing a parallel optical communications module to a host CB, the invention is not limited to use with parallel optical communications modules, but may be advantageously used with modules of any type that have arrays of electrical contacts that are to be interfaced with any array of a host CB. Also, in the illustrative embodiment demonstrated in FIGS. 1-4B, the electrical contacts 5 and 12 are metal pads and metal spring fingers, respectively, of the type that are often used to electrically interface an LGA with a CB. However, other types of electrical contacts may be used for this purpose. Persons of skill in the art will understand that these and other modifications may be made and that all such modifications are within the scope of the invention.

What is claimed is:

1. A socketless land grid array (LGA) comprising:

a first mounting region of a first surface of a first host circuit board (CB);

a first array of electrical contacts disposed on the first surface of the first host CB in the first mounting region;

a first module mounted in the first mounting region, the first module having a first module CB, the first module CB having a second array of electrical contacts disposed on a first surface thereof, wherein the electrical contacts of the second array are in contact with respective electrical contacts of the first array;

passive alignment features on the first host CB and on the first module for passively aligning the first module with the first host CB to thereby align the electrical contacts of the first array with the respective electrical contacts of the second array when the first module is mounted in the first mounting region; and a first amount of non-electrically-conductive adhesive material disposed on the first surface of the first host CB in the first mounting region and on the first surface of the first module CB, wherein the first amount of adhesive material secures the respective electrical contacts of the first and second arrays to one another and secures the first surface of the first host CB to the first surface of the first module CB.

2. The socketless LGA of claim 1, wherein the first amount of adhesive material is in contact with the first array of electrical contacts.

3. The socketless LGA of claim 1, wherein the non-electrically-conductive adhesive material is epoxy.

4. The socketless LGA of claim 1, wherein the non-electrically-conductive adhesive material is glue.

5. The socketless LGA of claim 1, wherein the first module is a first parallel optical communications module.

6. The socketless LGA of claim 1, wherein the passive alignment features include at least first and second frame members of the first host CB that at least partially define the first mounting region and that come into contact with first and second sides, respectively, of the first module CB when the first module is mounted in the first mounting region.

7. The socketless LGA of claim 1, wherein the passive alignment features include at least first, second and third frame members of the first host CB that at least partially define the first mounting region and that come into contact with first, second and third sides, respectively, of the first module CB when the first module is mounted in the first mounting region.

8. The socketless LGA of claim 1, wherein the passive alignment features include at least a first male feature of the first host CB and at least a first complementarily-shaped and sized female feature of the first module CB that engage one another when the first module is mounted in the first mounting region.

9. The socketless LGA of claim 1, wherein the passive alignment features include at least a first and second males feature of the first host CB and at least a first and second complementarily-shaped and sized female features of the first module CB that engage one another, respectively, when the first module is mounted in the first mounting region.

10. The socketless LGA of claim 1, wherein the passive alignment features include at least a first male feature of the first module CB and at least a first complementarily-shaped and sized female feature of the first host CB that engage one another when the first module is mounted in the first mounting region.

11. The socketless LGA of claim 1, wherein the passive alignment features include at least a first and second males feature of the first module CB and at least a first and second complementarily-shaped and sized female features of the first host CB that engage one another, respectively, when the first module is mounted in the first mounting region.

12. The socketless LGA of claim 1, wherein the first host CB has at least a first active alignment feature for actively aligning the first module with the first host CB to thereby align the electrical contacts of the first array with the respective electrical contacts of the second array when the first module is mounted in the first mounting region.

13. The socketless LGA of claim 1, wherein the first module CB has a through hole formed through it for allowing the first amount of non-electrically-conductive adhesive material to be dispensed through the through hole into a space that exists between the first surface of the first module CB and the first surface of the first host CB.

14. An electrical interface for interfacing module circuit boards (CBs) with host CBs, the electrical interface comprising:

a plurality of mounting regions of a first surface of a first host CB;

a plurality of first arrays of electrical contacts disposed on the first surface of the first host CB in the respective mounting regions;

a plurality of first modules mounted in the respective mounting regions, each of the first modules having a first module CB having a second array of electrical contacts disposed on a first surface of the first module CB, wherein the electrical contacts of each of the first arrays are in contact with respective electrical contacts of a respective one of the second arrays;

passive alignment features on the first host CB and on the first modules for passively aligning the first modules with the respective mounting regions of the first host CB to thereby align the electrical contacts of the first array with the respective electrical contacts of the second array when the first modules are mounted in the respective mounting regions; and first amounts of non-electrically-conductive adhesive material disposed on the electrical contacts of the first and second arrays and securing the electrical contacts of the first array to the respective electrical contacts of the respective second array, and wherein the first amounts of non-electrically-conductive adhesive material are in contact with the first surfaces of the first host CB and of the first module CBs and secure the first module CBs to the first host CB in the respective mounting regions.

15. The electrical interface of claim 14, wherein the passive alignment features include frame members of the first host CB that at least partially define the mounting regions and that come into contact with sides of the respective first module CBs when the first modules are mounted in the respective mounting regions.

16. The electrical interface of claim 14, wherein the passive alignment features include male features of the first host CB and complementarily-shaped and sized female features of each of the first module CBs that engage one another when the first modules are mounted in the respective mounting regions.

17. The electrical interface of claim 14, wherein the first host CB has active alignment features for actively aligning the first modules with the respective mounting regions to thereby align the electrical contacts of the first arrays with the respective electrical contacts of the second arrays when the first modules are mounted in the respective mounting regions.

18. The electrical interface of claim 14, wherein the first module CBs have respective through holes formed through them for allowing the first amounts of non-electrically-conductive adhesive material to be dispensed through the through holes into spaces that exist between the first surfaces of the first module CBs and the first surface of the first host CB.

19. A socketless land grid array (LGA) comprising:

a first mounting region of a first surface of a first host circuit board (CB);

a first array of electrical contacts disposed on the first surface of the first host CB in the first mounting region;

a first module mounted in the first mounting region, the first module having a first module CB, the first module CB having a second array of electrical contacts disposed on a first surface thereof, wherein the electrical contacts of the second array are in contact with respective electrical contacts of the first array;

at least a first active alignment feature on the first host CB for actively aligning the first module with the first host CB to thereby align the electrical contacts of the first array with the respective electrical contacts of the second array when the first module is mounted in the first mounting region; and a first amount of non-electrically-conductive adhesive material disposed on the first surface of the first host CB in the first mounting region and in contact with the first array of electrical contacts, and wherein the first amount of adhesive material secures the respective electrical contacts of the first and second arrays to one another and secures the first surface of the first host CB to the first surface of the first module CB.

* * * * *